US005184484A

United States Patent [19]

Yoo

[11] Patent Number: 5,184,484

[45] Date of Patent: Feb. 9, 1993

[54] YARN FEEDING APPARATUS HAVING YARN BREAK PROTECTION

[76] Inventor: Jae Poong Yoo, 76-42 Dong-A Villa B02Ho, Cheolsan 2-Dong, Kwangmyung, Kyungki-Do, 423-032, Rep. of Korea

[21] Appl. No.: 640,370

[22] PCT Filed: Jun. 18, 1990

[86] PCT No.: PCT/KR90/00006

§ 371 Date: Feb. 5, 1991

§ 102(e) Date: Feb. 5, 1991

[87] PCT Pub. No.: WO90/15891

PCT Pub. Date: Dec. 27, 1990

[30] Foreign Application Priority Data

Jun. 17, 1989 [KR] Rep. of Korea ..... 8360

[51] Int. Cl.[5] ..... D04B 15/48

[52] U.S. Cl. ..... 66/132 R; 66/125 R; 242/47.01; 242/47.12

[58] Field of Search ..... 66/125 R, 132 R; 242/47, 47.01, 47.12

[56] References Cited

U.S. PATENT DOCUMENTS

| | | | |
|---|---|---|---|
| 3,131,729 | 5/1964 | Leysinger | 66/132 X |
| 3,831,875 | 8/1974 | Jacobsson | 242/47.01 X |
| 3,940,079 | 2/1976 | Vella | 66/132 R X |
| 4,026,484 | 5/1977 | Naegeli | 242/47.12 X |
| 4,574,597 | 3/1986 | Buck et al. . | |
| 4,754,936 | 7/1988 | Dalmau Güell et al. | 66/132 R X |
| 4,793,565 | 12/1988 | Fecker . | |

FOREIGN PATENT DOCUMENTS

| | | | |
|---|---|---|---|
| 2308203 | 9/1974 | Fed. Rep. of Germany | 66/132 R |
| 2540749 | 3/1977 | Fed. Rep. of Germany . | |
| 2027456 | 2/1980 | United Kingdom . | |

*Primary Examiner*—Andrew M. Falik
*Assistant Examiner*—John J. Calvert
*Attorney, Agent, or Firm*—Christie, Parker & Hale

[57] ABSTRACT

Yarn feeding apparatus for a knitting machine in which a rotary cap driven by a motor is provided at the top of a storage drum. Optionally, an idle pulley may also be provided adjacent the lower portion of a driving wheel and a mechanism for shifting the driving belt alternately between the driving wheel or idle pulley, so that the driving of the machine is stopped in case of abnormal tension imparted to a feeding yarn. Shifting to either constant feeding or free feeding of yarn is possible to be executed automatically. Automation is possible for work for forming the yarn loop on the storage drum without requiring manual operation one-by-one by an operator. Therefore, it helps avoid poor knitting quality and thus avoids cutting off the yarn. It serves to automate the knitting machine so that constant feeding and free feeding of yarn are simply and conveniently executed.

13 Claims, 4 Drawing Sheets

Fig. 4
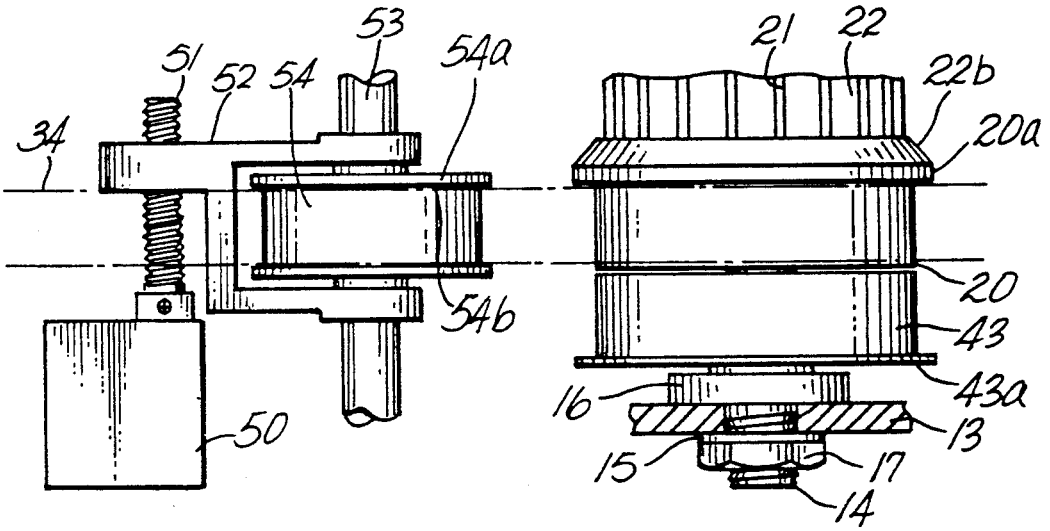
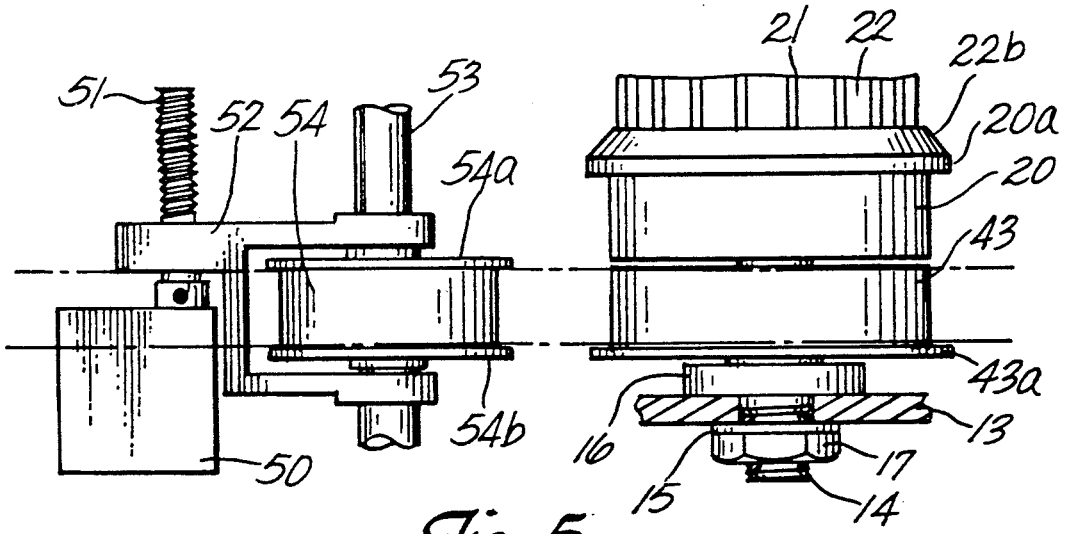
Fig. 5

YARN FEEDING APPARATUS HAVING YARN BREAK PROTECTION

TECHNICAL FIELD

The present invention relates to a yarn feeding apparatus for a knitting machine and, more particularly, to a yarn feeding apparatus which, in response to abnormal tension on the yarn, allows a yarn loop wound on a storage drum to be unwound, and then halts operation of the machine, whereby the yarn will not break, and thus yarn feeding can be readily resumed.

BACKGROUND ART

In general, a knitting machine includes a number of yarn feeding apparatuses corresponding to the number of bobbins in order to feed each yarn as it is unwound from each bobbin to knitting needles within the interior of the knitting machine. An example of such a yarn feeding apparatus is disclosed in Korean Patent Publication No. 86-1053. Such apparatus has a storage drum equipped with a driving wheel driven by an endless tape. A number of conical surfaces are provided coaxially with each other at the upper and lower portions of a holder. Winding and unwinding is simultaneously executed to wind each yarn a predetermined number of turns around a storage drum.

In such an apparatus, the yarn arranged on the storage drum smoothly feeds yarn to the interior of the knitting machine. However, since an operator winds the yarn one-by-one on the storage drum to form each yarn loop, not only is the work cumbersome, but it also causes feeding tension differences in each yarn where the number of turns of yarn formed on each storage drum are different from each other.

In presently known and used yarn feeding apparatus, when abnormal tension is imparted to the yarn which is being unwound from the bobbin due to any defect in the bobbin itself, there is no mechanism capable of absorbing the increased tension. Therefore, the yarn will often break easily.

Further, when it is desired to change over from a positive type feeding to a free feeding to accommodate a switch in textile structure, generally, either a driving belt wound on the driving wheel is manually removed, or a locking device mounted on each driving wheel is handled one-by-one to allow the storage drum to be freely rotated. However, since these changeover processes are cumbersome and difficult to automate, there has been a problem that productivity is reduced.

SUMMARY OF THE INVENTION

Therefore, the present invention provides a yarn feeding apparatus for a knitting machine in which a rotary cap driven by a motor is provided on an upper part of a storage drum. The structure is such that, when an abnormal tension is imparted to the yarn fed thereto, the yarn loop wound on the storage drum unwinds, and, simultaneously, the driving of the machine is stopped, so that the yarn feeding can be executed without breaking or disconnecting the yarn.

The present invention also provides a yarn feeding apparatus for a knitting machine in which an idle pulley is provided adjacent to the bottom of a driving wheel. A shifting mechanism for shifting a driving belt to either the driving wheel or the idle pulley is provided at one side. The shifting mechanism serves to change the yarn feeding condition between positive feeding or free feeding under motor control.

According to one embodiment of the present invention, a hollow shaft is fixed at the central portion of the base of a hollow holder The holder is equipped with a clamper at a side of the holder. A driving wheel equipped integrally with a storage drum above it is rotatably mounted via a bearing to the hollow shaft. A cylindrical mounting member is attached to the top end of the hollow shaft to support a motor in the interior of the mounting member, whereby it is located at the inside of the storage drum. A hollow threaded tube formed with female threads on the internal circumferential surface is fixed on the upper surface of the motor, and a coupling member having a rectangular section is fixed to the rotary shaft of the motor. A movable threaded tube formed with male thread on the external circumferential surface thereof and having a rectangular groove to be coupled with the coupling member fixed to the rotary shaft of the motor is engaged with the hollow threaded tube. A rotary cap having a semispherical surface at an upper end portion is fixed to the top end of the movable threaded tube. A protrusion having a yarn-inducing hole is provided on a side of the semispherical surface of the rotary cap, and another yarn-inducing hole is provided at the bottom end portion of the rotary cap directly below the protrusion, whereby it is made such that the yarn to be passed through the first and second yarn-inducing holes is made to be wound on the storage drum in response to the rotation of the rotary cap. A push button switch is provided at the neck portion of the hollow holder. The rotary cap is moved to its upper position according to the rotation of the motor, the switch button is pressed by the protrusion of the rotary cap, and in response thereto, the apparatus stops rotation of the rotary cap and simultaneously causes the driving wheel and the storage drum to rotate by applying driving force to the driving belt and thereby the feeding of yarn is executed. By rotating the cap until it moves from its lower position to the upper position, the protrusion will press the button portion of the push button switch. The rotary cap has, at this time, wound yarn onto the drum in an amount determined by the turning number of the rotary cap between the lower and upper positions. The driving of the knitting machine is started when the rotary cap is stopped due to the switch. Thereafter, the amount of yarn wound on the storage drum is maintained as yarn feeding continues as the knitting machine pulls on the yarn. When an abnormal tension is imparted to the yarn being supplied in this state, e.g., due to phenomena occurring at the bobbin, the protrusion of the rotary cap is released from the push button switch due to the tensional force, and then the storage drum and the rotary cap are simultaneously rotated, and thereby the yarn loop formed on the storage drum becomes unwound, whereby the feeding of yarn to the machine continues to be executed. Simultaneously with this, since the pressed state of the button portion of the push button switch becomes released, the operation of the knitting machine is stopped, whereby breaking of the yarn can be prevented by stopping the knitting machine before all of the yarn wound on the drum is used up.

A preferred embodiment of the present invention as above is for constant feeding of yarn, but according to another embodiment of the present invention, the yarn can be freely fed upon knitting of tissue, such as a jacquard tissue, only by adding simple components. That is, the feeding apparatus is adapted such that the bottom end portion of the hollow shaft is extended, and an idle pulley is provided between the driving wheel and base portion of the holder. A driving belt shifting pulley to be shifted by a motor capable of rotating in normal and reverse directions is provided at an appropriate position. For constant feeding of yarn, the driving belt is made to be wound on the driving wheel, and for free feeding of yarn, the driving belt shifting pulley is made to be dropped down by the rotation of a motor, whereby the driving belt is made to be wound on the idle pulley, so that the storage drum can be freely rotated according to the pulling force of the knitting machine itself.

BRIEF DESCRIPTION OF THE DRAWINGS

FIGS. 4 and 5 are schematic explanatory diagrams of a yarn feeding apparatus according to another embodiment of the present invention, in which FIG. 4 is a side view showing the apparatus during feeding of the yarn, and FIG. 5 is a side view showing the apparatus during free feeding of the yarn.

DETAILED DESCRIPTION OF THE PREFERRED EMBODIMENTS

Figure 1:
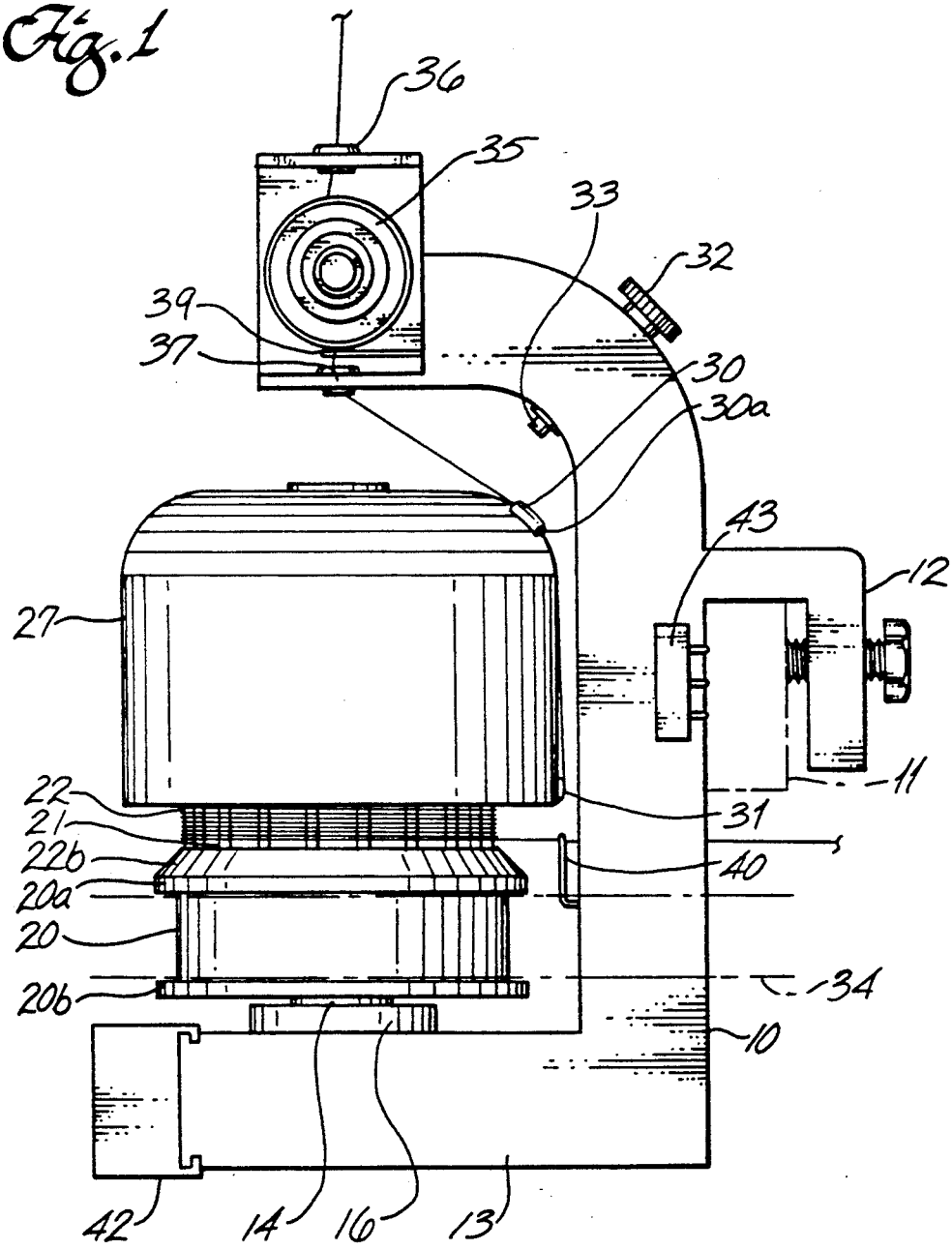
FIG. 1 is a side view of a yarn feeding apparatus according to a preferred embodiment of the present invention adapted for use with a knitting machine.

Hereinafter, the preferred embodiments of the present invention will be described in detail with reference to the accompanying drawings In the drawings, i.e., FIGS. 1-3, a yarn feeding apparatus has a clamper 12 for fixing a hollow holder 10 to a supporting ring 11 of a knitting machine. The clamper is provided at a vertical position at one side of the yarn feeding apparatus. The apparatus also has a hollow shaft 14 which is fixed at its bottom end to a central side of a base 13 by a nut 17 acting through washers 15 and 16. A driving wheel 20, having upper and lower flanges **20*a* and 20*b*, is rotatably mounted to the hollow shaft 14 at the top side of base 13 via a bearing 18. A storage drum 22 has conical surfaces 22*a* and 22*b* and is provided with a number of pins 21 ("spinning pins") at predetermined intervals on the external surface thereof to assist in supporting yarn on the drum. The drum 22 is formed integrally with the driving wheel 20**.

A mounting member 19 of cylindrical shape is attached to the top end portion of hollow shaft 14, and a motor 23 is inserted and fixed within the interior of the mounting member so as to be located within the interior of the storage drum 22. A hollow threaded tube 23, having a female thread portion on its internal circumferential surface, is fixed on the top surface of the motor 23, and a coupling member 25 having rectangular section is attached to a rotary shaft **23*a* of the motor. A movable threaded tube 26, formed with a male thread portion on its external circumferential surface and having a rectangular groove 26*b* to be coupled with said coupling member 25 at the internal circumferential surface of the tube 26, is coupled at its external surface with the hollow threaded tube 24**.

A rotary cap 27, having a semispherical-shaped surface at its top end, is fixed to the top end of the movable threaded tube 26 such that the rotary cap 27 almost surrounds the storage drum 22 when the movable threaded tube 26 is completely threaded onto the hollow tube 24. A protective cap 28, having a slightly larger diameter than the hollow threaded tube 24 and having a length about equal to that of the movable threaded tube 26, is fixed to the inner side of the rotary cap 27 in order to prevent any extraneous substances, such as dust, from entering the threaded portion of the movable threaded tube 26. Stops **24*a* and 29*a* are respectively formed at a top end portion of the hollow threaded tube 24 and at a washer 29 fixed to the front end side of the movable threaded tube 26 in order to limit the lower movement of the cap 27. A protrusion 30, having a third yarn-inducing hole 30*a*, is provided at a side of the semispherical surface of the rotary cap 27, and a fourth yarn-inducing hole 31 is provided at the bottom end of the rotary cap 27 substantially vertically below protrusion 30**.

A push button switch 33 protrudes inward from a neck portion of hollow holder 10. A knob 32 is also provided at the neck portion of the hollow holder 10 to adjust how much button 33 protrudes. When the button of the switch 33 is contacted and depressed by the protrusion 30 of the rotary cap 27, rotation of the rotary cap is stopped. Simultaneously, the driving of the knitting machine is started, and then the driving wheel 20 and the storage drum 22 are rotated according to the driving force of the driving belt 34, so that the yarn is fed. A yarn stopper 35 is provided at the front end portion of the hollow holder 10, and first and second yarn-inducing holes 36 and 37 located on the rotational center of the rotary cap 27 are arranged at upper and lower sides of the yarn stopper 35, and a yarn-running sensor 39 and a yarn-stopping sensor 40 are respectively provided at the neck portion and the vertical portion of the hollow holder 10. A fifth yarn-inducing hole 41 receives the end of the yarn which has passed through the first, second, third, and fourth yarn-inducing holes 36, 37, **30*a*, and 31 and which has been wound on the storage drum 22. This end of the yarn passes through hole 41** to the interior of the knitting machine.

A signal lamp 42 is provided so that when a yarn becomes disconnected or its feeding stops, the lamp indicates such disconnection or stoppage. A terminal jack 43 is provided electrically connecting push button switch 33, yarn-running sensor 39, yarn-stopping sensor 40, and motor 23 to a central control unit provided in the main body of the knitting machine.

In the above embodiment, the upper and lower conical surfaces **22*a* and 22*b* of the storage drum 22 are shown as formed on the storage drum itself, but they also may be formed by bending the upper and lower end portions of the pins 21 so as to have an appropriate slant angle. It is also possible to eliminate the pins 21 by integrally forming a concave and convex portion on the surface of the storage drum 22 of the same shape as the pins 21**, respectively.

The motor 23 for rotating cap 27 is a DC motor capable of normal and reverse rotation and preferably is one that can be driven selectively by electric power of 6V, 9V, 12V, or 24V, according to the kind of yarn to be fed. The stops **24*a* and 29*a* formed on the fixed washer 29 of the movable threaded tube 26 and the top end portion of the hollow threaded tube 24, respectively, are desirable to be formed so that the fourth yarn-inducing hole 31 of the rotary cap 27 is located at a closest position to the fifth yarn-inducing hole 41 on the holder 10 when the rotary cap 27 is located at the lower position, that is, when the stops 24***a* and 29*a* contact each other.

The operational condition and effect of the yarn feeding apparatus according to a preferred embodiment of the present invention having the construction as above will be described in detail hereinafter.

Figure 2:
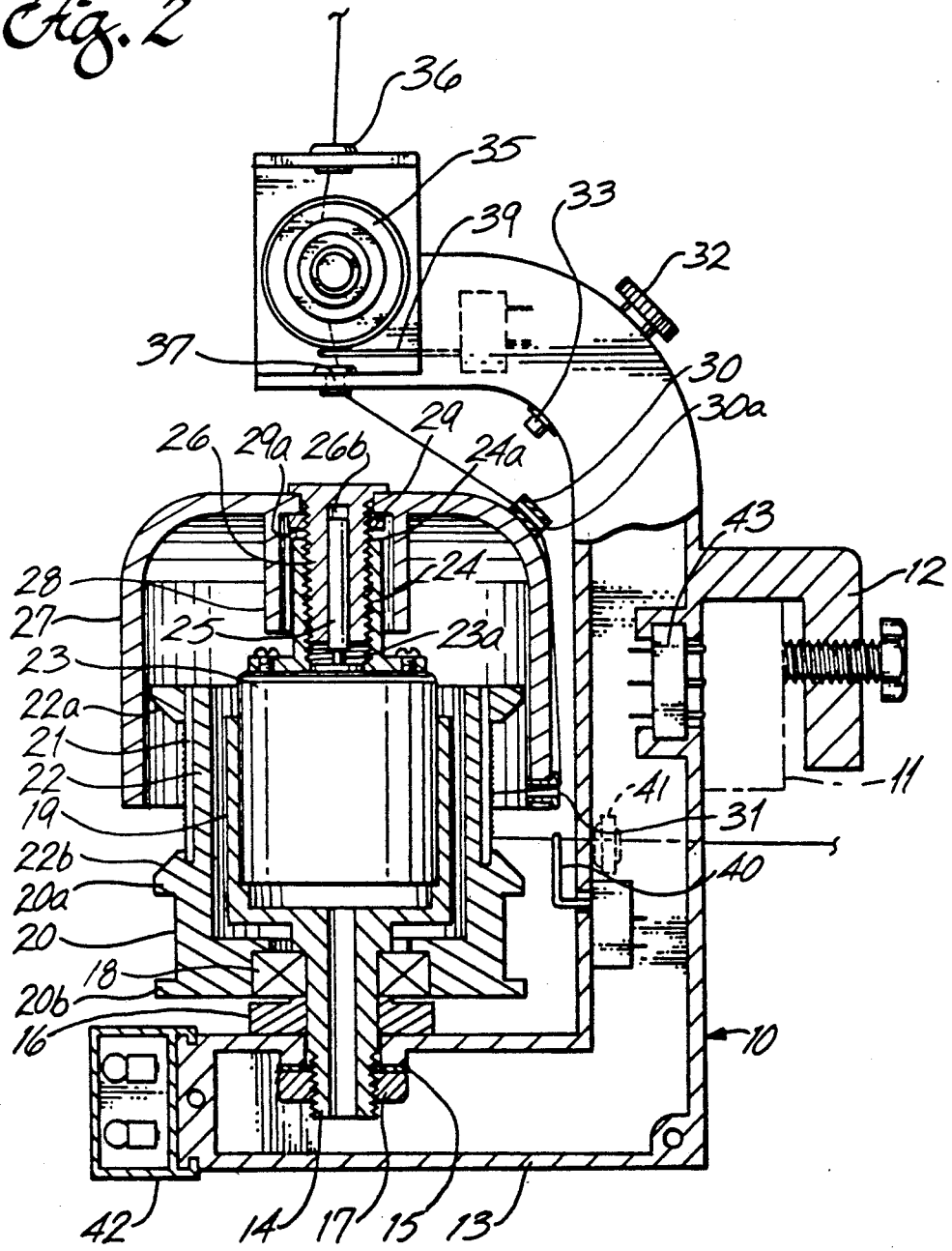
FIG. 2 is a longitudinal cross-sectional view of FIG. 1.
Figure 3:
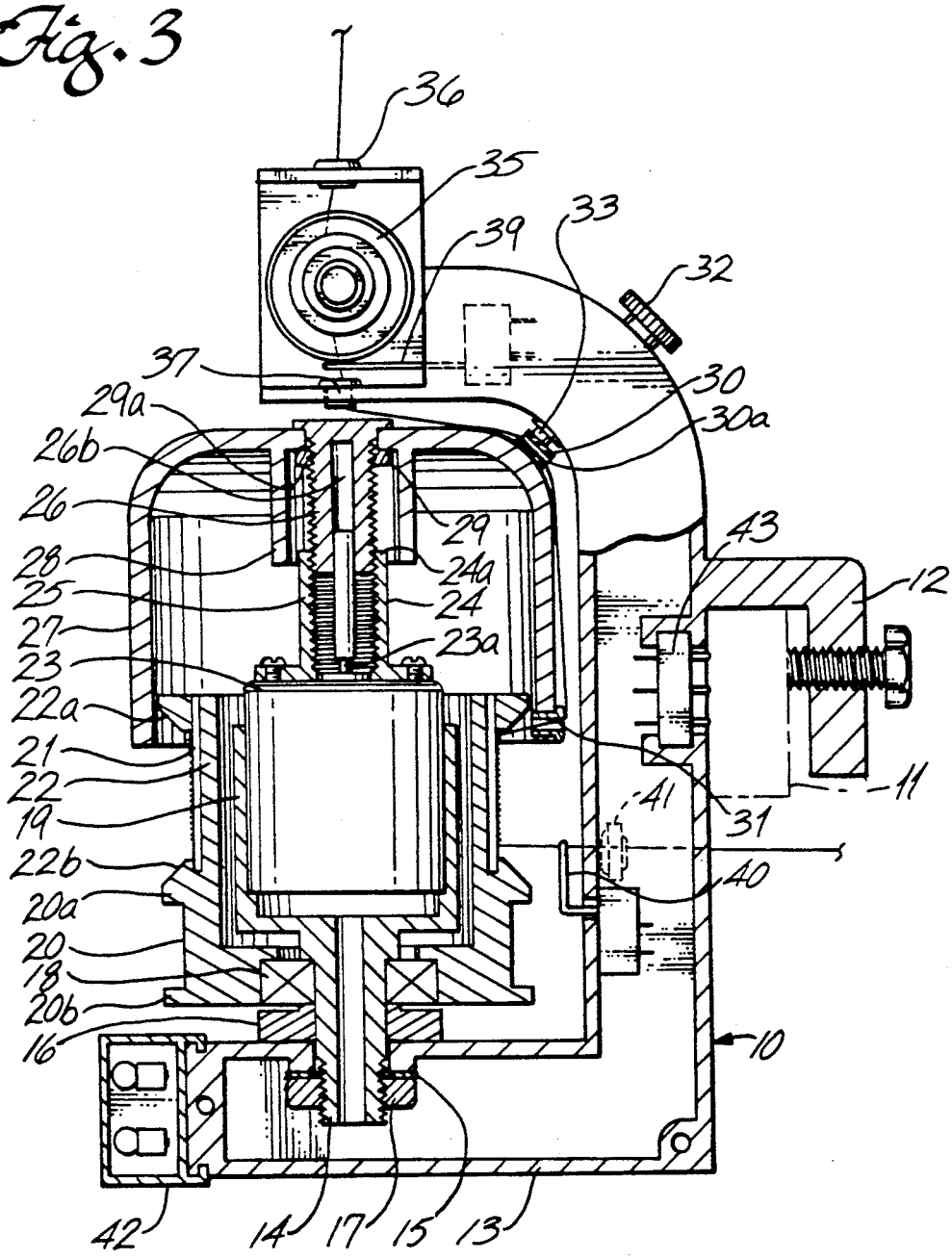
FIG. 3 is a longitudinal cross-sectional view of a yarn feeding apparatus according to a preferred embodiment of the present invention showing a state where yarn is being fed during operation of the knitting machine.

When the knitting machine is in a stopped state, the rotary cap 27 is located at a lower position, as shown in FIGS. 1 and 2. At this time, the yarn from the bobbin is connected to the interior of the knitting machine through the first and second yarn-inducing holes 36 and 37 of the holder 10, the third and fourth yarn-inducing holes 31*a* and 31 provided at the protrusion 30 and the lower peripheral portion of the rotary cap 27, and the fifth yarn-inducing hole 41 of the holder 10. In this state, when electric power supply is fed from the central control unit of the knitting machine to the motor 23 to rotate the motor 23, the movable threaded tube 26 and the rotary cap 27 are rotated and move upward, and thereby wind the yarn onto the storage drum 22, thus forming yarn loops corresponding to the number of turns of the cap 27. The motor 23 is stopped at the moment that the rotary cap 27 has executed a predetermined number of rotations, i.e., when the protrusion 30 formed on the semispherical surface contacts the button portion of the push button switch 33 mounted on the neck portion of the holder 10, and thereby the protrusion 30 of the rotary cap 27 presses the push button switch 33. In response, the central control unit of the knitting machine drives the knitting machine. The driving force of the knitting machine is transmitted to the driving wheel 20 through the driving belt 34, whereby the driving wheel 20 and the storage drum 22 are simultaneously rotated. This causes the yarn to be constantly fed into the interior of the knitting machine. At this moment, since the driving wheel 20 and the storage drum 22 are rotated while the rotary cap 27 is stopped, the yarn being wound from the storage drum 22 is simultaneously replaced with yarn being wound onto the drum, due to the rotation of the drum.

For the number of turns of such yarn wound on the drum, i.e., the yarn to be wound on the storage drum 22, adjustment is possible according to the desired requirements. That is, the upper limit of movement of the rotary cap 27 can be appropriately selected by adjusting the amount of protrusion of the push button switch 33 by using knob 32. Generally, even though the desired total length of the yarn wound around the storage drum 22 may vary, depending upon the kind or strength of the yarn, it will usually be sufficient if the total length is approximately 1.5 m. If the circumference of the storage drum 22 is approximately 15 cm, to obtain the 1.5 m of yarn on the drum, the cap must rotate ten times. Therefore, the button portion of the push button switch 33 and the protrusion 30 of the cap 27 are made to contact at an upper position corresponding to about 10 turns from the lower position of the cap 27.

As described above, as the yarn is being fed to the knitting machine, if a tension of more than a predetermined amount is imparted to the feeding yarn due to a defect at the bobbin, the protrusion 30 of the rotary cap 27 is pulled away from the push button switch 33 by the yarn pulling force of the knitting machine itself, due to the loss of slack in the yarn from the bobbin. The rotary cap 27 will thus rotate together with the storage drum 22. In this state, substantially no new yarn will be wound on the storage drum 22, so the amount of yarn wound on the drum will be reducing as the knitting machine uses it up. As can be seen, even though the yarn feeding to the storage drum 22 has stopped, the yarn feeding to the interior of the knitting machine is not instantly stopped. As noted above, simultaneously with the reduction in yarn on the drum, the rotary cap 27 rotates in reverse direction (relative to the above description of initial winding of yarn onto the drum), so the cap 27 moves to the lower position. Accordingly protrusion 30 comes free from the push button switch 33. Therefore, the switch 33 returns to the OFF state, whereby the driving of the knitting machine is stopped by the central processing unit. The abnormal tension being imparted to the feeding yarn is usually due to phenomena that cause the yarn wound on the bobbin to instantaneously stop unwinding. As noted above, if this tension is sufficient, the cap 27 will be pulled and will rotate to move downward, thus causing the knitting machine to stop. To restart the machine, motor 23 is pulsed toward the upper position. Therefore, an electric current of 6V, 9V, 12V, or 24V is fed again from 2 to 3 times for about 1.5 seconds each time (under the control of the central control unit). Thus, after 4–5 seconds elapses from stoppage of the knitting machine, i.e., after two to three pulses, if the tension imparted to the yarn was due to a simple defect of the bobbin, the yarn will not break and will be quickly loosened by the pulsing, and will re-feed so that cap 27 moves upward again to contact the protrusion 30 and switch 33, thereby automatically resuming an operating condition of the knitting machine. However, when the abnormal tension persists, even after stoppage of the knitting machine, and after the above pulsing, a signal lamp 42 is lit, and at the same time, a signal tone is sounded to thereby prompt an operator to manually check the feeding condition of the yarn.

In the above description, the driving voltage fed to the motor 23 is selectively determined, depending upon the kind and strength of the yarn. For a yarn which is weak in strength, such as cotton yarn, a weak voltage of about 6V is fed. For a yarn which is relatively strong, such as polyethylene yarn, a strong voltage of about 12V or 24V is used.

According to a preferred embodiment of the present invention as above, automation is possible for the operation of forming the yarn loop on the storage drum by rotating the rotary cap by utilizing a motor. Therefore, no one-by-one manual operation is required. Further, when an abnormal tension is imparted to a feeding yarn, the rotary cap and the storage drum are made to be simultaneously rotated, and thereby the yarn wound on the storage drum unwinds to alleviate the tension. If the tension remains, the knitting machine will automatically be stopped in response to downward movement of the cap. Thereafter, if there is still abnormal tension, the motor will be pulsed to eliminate it. If the tension still remains, the feeder indicates this. Therefore, poor knitting is minimized or avoided by minimizing or avoiding breakage of the yarn.

Hereinafter another embodiment of the present invention will be described in detail with reference to FIGS. 4 and 5. In the drawings, for the simplicity of expression, diagrams of such parts having the same construction as in the first embodiment of the present invention are omitted, and components which are the same as in the first embodiment are represented by the same reference numerals.

As shown in FIGS. 4 and 5, an idle pulley 43 is provided via a bearing (not shown) coaxially with the driving wheel 20 at the extended end portion of hollow shaft 14, and a reduction motor 50, capable of normal and reverse rotation and having a screw shaft 51, is mounted at one side thereof. A U-shaped support frame 52 is coupled to screw shaft 51, and a shifting wheel 54 guided by a guide shaft 53 is mounted to the interior of a support frame 52. Annular flanges 54*a* and 54*b* are provided respectively to the wheel 54 so that the driving belt 34 will not be removed therefrom when shifting the driving belt to either the driving wheel or the idle pulley 43 by the rotation of the reduction motor 50. The driving wheel 20 and the idle pulley 43 are not equipped with any flanges at their adjacent portions so that the shifting of the driving belt 34 is smooth.

This embodiment is applicable when free feeding of the yarn is required in order to change the fiber tissue. For example, if a constant feeding of the yarn is required, such as for plain tissue, the driving belt 34 is wound on the driving wheel 20, as shown in FIG. 4, and when free feeding of the yarn is required, such as for jacquard tissue, the shifting wheel 54 is made to drop down by driving the reduction motor 50, so that the driving belt 34 is removed from the driving wheel and is wound on the idle pulley 43. Therefore, the storage drum 22 is free, thereby enabling free yarn feeding in response to the pulling force of the knitting machine itself.

In this embodiment, not only is the shifting of the constant feeding and free feeding of the yarn simple and convenient but also it helps further automate the knitting machine.

I claim:

1. A yarn feeding apparatus for a knitting machine, comprising:

a holder having a clamper for fixing to a support ring of the knitting machine and first and second yarn-inducing holes at a front end portion of the holder;

a hollow shaft fixed to a base portion of said holder;

a driving wheel rotatably mounted to said hollow shaft and driven by a driving belt;

a storage drum on which pins are arranged at predetermined intervals on its external circumferential surface and having upper and lower conical surfaces, said storage drum being mounted to said driving wheel for rotation therewith;

a motor located within the interior of said storage drum and fixed by a fixing member attached to a front end portion of said hollow shaft, and having a rotary shaft protruding therefrom;

a hollow threaded tube fixed to said motor around said rotary shaft;

a movable threaded tube mounted to the rotary shaft of said motor for rotational movement with the rotary shaft and threaded to said hollow threaded tube;

a rotary cap fixed to a front end portion of said movable threaded tube and having a semispherical surface at an upper portion, said rotary cap being movable between lower and upper positions in response to rotation of said rotary shaft;

a protrusion provided on the semispherical surface of said rotary cap and having a third yarn-inducing hole formed in said protrusion;

a push button switch provided at a neck portion of said holder in a position corresponding to a position of the protrusion at the upper position of said rotary cap;

a fourth yarn-inducing hole arranged at a bottom side portion of said protrusion; and a fifth yarn inducing hole arranged at a vertical portion of the holder, wherein upper and lower conical surfaces of said storage drum are formed by bending upper and lower end portions of the pins.

2. The yarn feeding apparatus according to claim 1, wherein said driving wheel and storage drum are integrally formed by the pins.

3. The yarn feeding apparatus according to claim 1, wherein first and second mechanical stops are formed on a front end portion of said hollow threaded tube and on a bottom surface to a washer for fixing said rotary cap, respectively, for contacting each other when said rotary cap is in the lower position, and wherein when said rotary cap is in the lower position, said fourth yarn-inducing hole and said fifth yarn-inducing hole are located in positions closest to each other, relative to when said rotary cap is in positions other than said lower position.

4. The yarn feeding apparatus according to claim 1, wherein a protection cap having a length almost the same as said movable threaded tube and a diameter slightly larger than a diameter of said hollow helical tube is attached to the bottom surface of said rotary cap.

5. The yarn feeding apparatus for a knitting machine, comprising:

a storage drum for having yarn from a bobbin wound thereon and for supplying the yarn wound thereon to the knitting machine;

means for rotatably mounting the storage drum to the support, and means for rotating the storage drum;

a motor supported in the storage drum;

a rotary cap;

means for connecting the rotary cap to the motor for rotating the rotary cap in response to energizing of the motor to move the rotary cap away from the storage drum in response to rotation of the rotary cap in one direction and toward the storage drum in response to rotation of the rotary cap in the other direction;

a switch mounted on the support actuable for turning off the motor and turning on the knitting machine, wherein the rotary cap has a contact for contacting the switch to actuate the switch;

means attached to the support for guiding yarn from the bobbin;

means attached to the rotary cap for further guiding yarn after the yarn passes from the yarn guiding means, and for winding the yarn onto the storage drum in response to rotation of the rotary cap; and means attached to the support for still further guiding yarn from the storage drum to the knitting machine, wherein movement of the rotary cap away from the storage drum is adapted to wind the yarn onto the storage drum until the contact contacts the switch, thereby turning off the motor and turning on the knitting machine.

6. The yarn feeding apparatus of claim 5, wherein the means for connecting the rotary cap includes a movable threaded tube for enabling rotation of the rotary cap in the other direction in response to the yarn on the storage drum being unwound by the knitting machine faster than yarn is being wound onto the storage drum.

7. The yarn feeding apparatus of claim 6, wherein the switch includes means for de-actuation in response to movement of the rotary cap toward the storage drum and, in response thereto, the knitting machine is de-activated. wherein the motor is responsive to de-actuation of the switch, and wherein the motor is initially pulsed on and off in response to de-actuation of the switch, then maintained on until the contact contacts the switch, and further comprising means for providing an indication in response to failure of the contact to contact the switch within a predetermined time.

8. A yarn feeding apparatus for a knitting machine, comprising:

a holder having a clamper for fixing to a support ring of the knitting machine and first and second yarn-inducing holes at a front end portion of the holder;

a hollow shaft fixed to a base portion of said holder;

a driving wheel rotatably mounted to said hollow shaft and driven by a driving belt;

a storage drum on which pins are arranged at predetermined intervals on its external circumferential surface and having upper and lower conical surfaces, said storage drum being mounted to said driving wheel for rotation therewith;

a motor located within the interior of said storage drum and fixed by a fixing member attached to a front end portion of said hollow shaft, and having a rotary shaft protruding therefrom;

a hollow threaded tube. fixed to said motor around said rotary shaft;

a movable threaded tube mounted to the rotary shaft of said motor for rotational movement with the rotary shaft and threaded to said hollow threaded tube;

a rotary cap fixed to a front end portion of said movable threaded tube and having a semispherical surface at an upper portion, said rotary cap being movable between lower and upper positions in response to rotation of said rotary shaft;

a protrusion provided on the semispherical surface of said rotary cap and having a third yarn-inducing hole formed in said protrusion;

a push button switch provided at a neck portion of said holder in a position corresponding to a position of the protrusion at the upper position of said rotary cap;

a fourth yarn-inducing hole arranged at a bottom side portion of said protrusion; and a fifth yarn inducing hole arranged at a vertical portion of the holder, wherein said first and second yarn-inducing holes are located on a rotational central axis of said rotary cap.

9. A yarn feeding apparatus for a knitting machine, comprising:

a holder having a clamper for fixing to a support ring of the knitting machine and first and second yarn-inducing holes at a front end portion of the holder;

a hollow shaft fixed to a base portion of said holder;

a driving wheel rotatably mounted to said hollow shaft and driven by a driving belt;

a storage drum on which pins are arranged at predetermined intervals on its external circumferential surface and having upper and lower conical surfaces, said storage drum being mounted to said driving wheel for rotation therewith;

a motor located within the interior of said storage drum and fixed by a fixing member attached to a front end portion of said hollow shaft, and having a rotary shaft protruding therefrom;

a hollow threaded tube fixed to said motor around said rotary shaft;

a movable threaded tube mounted to the rotary shaft of said motor for rotational movement with the rotary shaft and threaded to said hollow threaded tube;

a rotary cap fixed to a front end portion of said movable threaded tube and having a semispherical surface at an upper portion, said rotary cap being movable between lower and upper positions in response to rotation of said rotary shaft;

a protrusion provided on the semispherical surface of said rotary cap and having a third yarn-inducing hole formed in said protrusion;

a push button switch provided at a neck portion of said holder in a position corresponding to a position of the protrusion at the upper position of said rotary cap;

a fourth yarn-inducing hole arranged at a bottom side portion of said protrusion; and a fifth yarn inducing hole arranged at a vertical portion of the holder, wherein said motor is selectively driven by DC 6V, 9V, 12V, or 24V and capable of rotating in normal and reverse directions.

10. A yarn feeding apparatus for a knitting machine, comprising:

a holder having a clamper for fixing to a support ring of the knitting machine and first and second yarn-inducing holes at a front end portion of the holder;

a hollow shaft fixed to a base portion of said holder;

a driving wheel rotatably mounted to said hollow shaft and driven by a driving belt;

a storage drum on which pins are arranged at predetermined intervals on its external circumferential surface and having upper and lower conical surfaces, said storage drum being mounted to said driving wheel for rotation therewith;

a motor located within the interior of said storage drum and fixed by a fixing member attached to a front end portion of said hollow shaft, and having a rotary shaft protruding therefrom;

a hollow threaded tube fixed to said motor around said rotary shaft;

a movable threaded tube mounted to the rotary shaft of said motor for rotational movement with the rotary shaft and threaded to said hollow threaded tube;

a rotary cap fixed to a front end portion of said movable threaded tube and having a semispherical surface at an upper portion, said rotary cap being movable between lower and upper positions in response to rotation of said rotary shaft;

a protrusion provided on the semispherical surface of said rotary cap and having a third yarn-inducing hole formed in said protrusion;

a push button switch provided at a neck portion of said holder in a position corresponding to a position of the protrusion at the upper position of said rotary cap;

a fourth yarn-inducing hole arranged at a bottom side portion of said protrusion; and a fifth yarn inducing hole arranged at a vertical portion of the holder, wherein said push button switch extends from said neck portion a predetermined amount, said predetermined amount is adjustable by means of an adjusting knob.

11. The yarn feeding apparatus according to claim 10, wherein the predetermined amount defines the upper position of said rotary cap, and thereby limits a number of rotations of said rotary cap from the lower position to the upper position.

12. A yarn feeding apparatus for a knitting machine, comprising:

a holder having a clamper for fixing to a support ring of the knitting machine and first and second yarn-inducing holes at a front end portion of the holder;

a hollow shaft fixed to a base portion of said holder;

a driving wheel rotatably mounted to said hollow shaft and driven by a driving belt;

a storage drum on which pins are arranged at predetermined intervals on its external circumferential surface and having upper and lower conical surfaces, said storage drum being mounted to said driving wheel for rotation therewith;

a motor located within the interior of said storage drum and fixed by a fixing member attached to a front end portion of said hollow shaft, and having a rotary shaft protruding therefrom;

a hollow threaded tube fixed to said motor around said rotary shaft;

a movable threaded tube mounted to the rotary shaft of said motor for rotational movement with the rotary shaft and threaded to said hollow threaded tube;

a rotary cap fixed to a front end portion of said movable threaded tube and having a semispherical surface at an upper portion, said rotary cap being movable between lower and upper positions in response to rotation of said rotary shaft;

a protrusion provided on the semispherical surface of said rotary cap and having a third yarn-inducing hole formed in said protrusion;

a push button switch provided at a neck portion of said holder in a position corresponding to a position of the protrusion at the upper position of said rotary cap;

a fourth yarn-inducing hole arranged at a bottom side portion of said protrusion; and a fifth yarn inducing hole arranged at a vertical portion of the holder, wherein an idle pulley is mounted coaxially at a lower portion of said driving wheel, and said apparatus further comprises means for selectively shifting the driving belt to one of said driving wheel and said idle pulley.

13. The yarn feeding apparatus according to claim 12, wherein said shifting means includes a reduction motor having a screw shaft and capable of rotating in normal and reverse directions, a support frame shifted by the rotation of said screw shaft, a guide rod for guiding said support frame, and a shifting wheel movably mounted along the guide rod at an interior of said support frame.

* * * * *